US011369858B2

(12) United States Patent
Dulcamara et al.

(10) Patent No.: US 11,369,858 B2
(45) Date of Patent: Jun. 28, 2022

(54) HEEL UNIT COMPRISING A RELEASE AND ADJUSTMENT MECHANISM

(71) Applicant: Salewa Sport AG, Denges (CH)

(72) Inventors: Matthew Dulcamara, Aschheim (DE); Uwe Eckart, Aschheim (DE); Edwin Lehner, Aschheim (DE)

(73) Assignee: SALEWA SPORT AG, Denges (CH)

( * ) Notice: Subject to any disclaimer, the term of this patent is extended or adjusted under 35 U.S.C. 154(b) by 0 days.

(21) Appl. No.: 17/199,798

(22) Filed: Mar. 12, 2021

(65) Prior Publication Data

US 2021/0283491 A1 Sep. 16, 2021

(30) Foreign Application Priority Data

Mar. 13, 2020 (DE) ..... 10 2020 203 271.8

(51) Int. Cl.
*A63C 9/082* (2012.01)
*A63C 9/08* (2012.01)
*A63C 9/084* (2012.01)

(52) U.S. Cl.
CPC ..... *A63C 9/0807* (2013.01); *A63C 9/0844* (2013.01); *A63C 9/0846* (2013.01)

(58) Field of Classification Search
CPC ... A63C 9/0807; A63C 9/0844; A63C 9/0846; A63C 9/0053; A63C 9/0805; A63C 9/082; A63C 9/08521; A63C 9/08535; A63C 9/08; A63C 9/084; A63C 9/085
See application file for complete search history.

(56) References Cited

U.S. PATENT DOCUMENTS

2018/0353839 A1* 12/2018 Shute ..... A63C 9/0805

FOREIGN PATENT DOCUMENTS

| | | | |
|---|---|---|---|
| DE | 102013224574 | A1 | 6/2015 |
| DE | 102016014950 | A1 * | 6/2017 |
| DE | 102016014950 | A1 | 6/2017 |
| EP | 0199098 | A2 * | 10/1986 |
| EP | 0199098 | A2 | 10/1986 |

(Continued)

OTHER PUBLICATIONS

German Application No. 10 2020 203 271.8 Search Report, dated Oct. 13, 2020, 6 pages.

*Primary Examiner* — James A Shriver, II
*Assistant Examiner* — Michael T. Walsh
(74) *Attorney, Agent, or Firm* — Kilpatrick Townsend & Stockton LLP

(57) ABSTRACT

A heel unit for a touring binding includes a base for mounting on a sliding board and coupling means to engage a heel portion of a sliding board boot in a downhill position of the touring binding to retain the sliding board boot on the touring binding. A release mechanism holds the coupling means so as to be moveable relative to the base and releasable from the sliding board boot, in the downhill position, in an event of action of a force exceeding a predetermined release force. An adjustment mechanism adjusts the touring binding between the downhill position and a walking position in which the coupling means are remote from and do not engage the sliding board boot. The adjustment mechanism comprises an actuation assembly manually actuatable to lock or unlock the adjustment mechanism substantially without an actuation force or with an actuation force less than the predetermined release force.

20 Claims, 14 Drawing Sheets

(56) References Cited

FOREIGN PATENT DOCUMENTS

Figure 1:
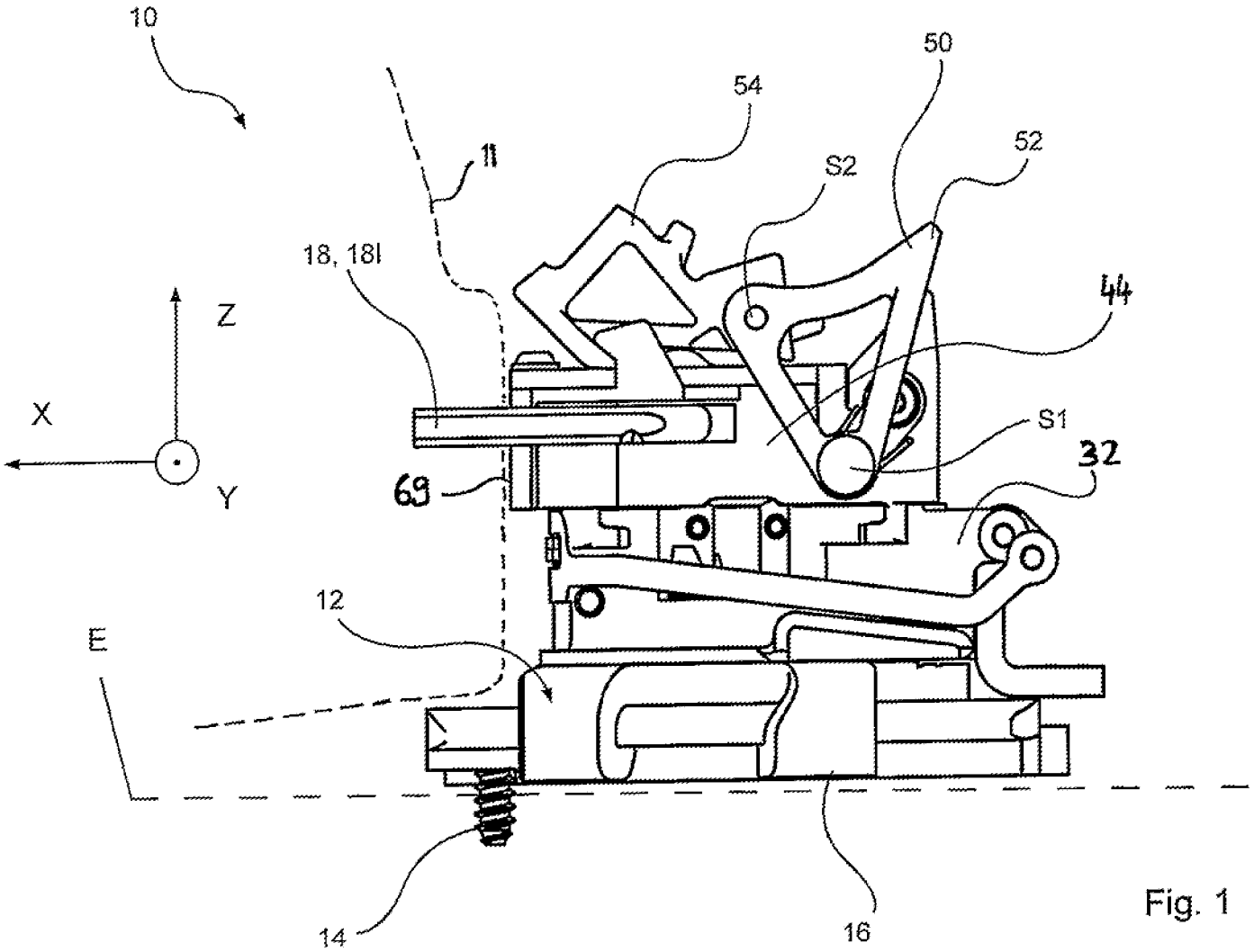

| | | | | | |
|---|---|---|---|---|---|
| EP | 2345462 | A1 * | 7/2011 | ..... | A63C 9/0807 |
| EP | 2545966 | A2 * | 1/2013 | ..... | A63C 9/0807 |
| EP | 2545966 | A2 | 1/2013 | | |
| EP | 3581248 | A1 * | 12/2019 | | |

* cited by examiner

10

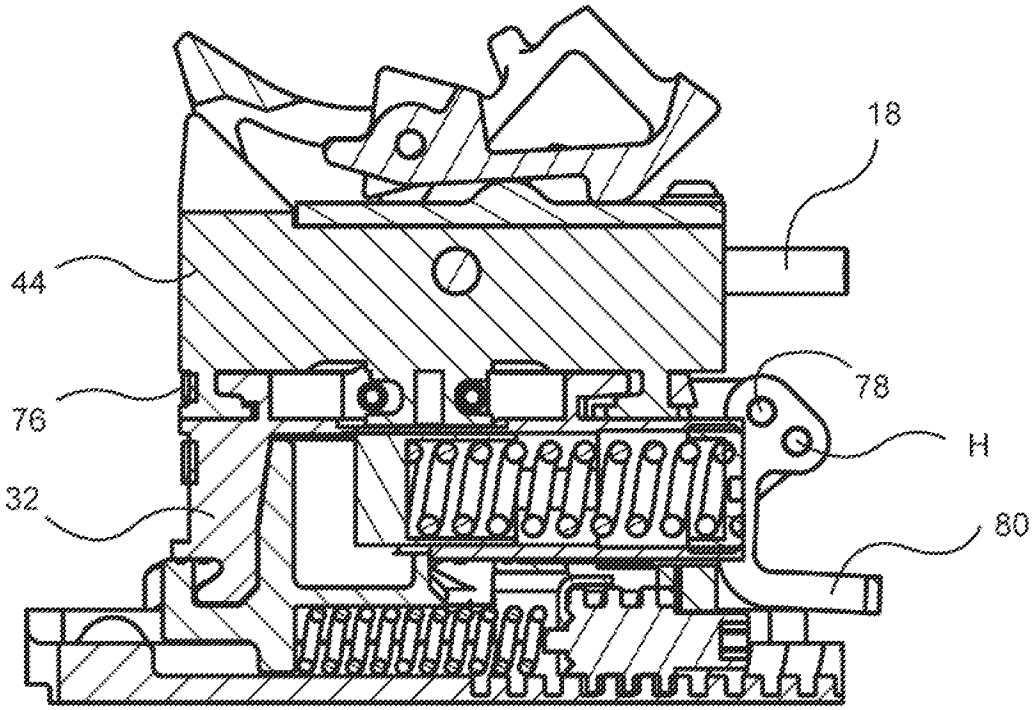
Fig. 5
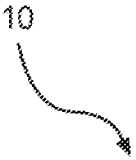

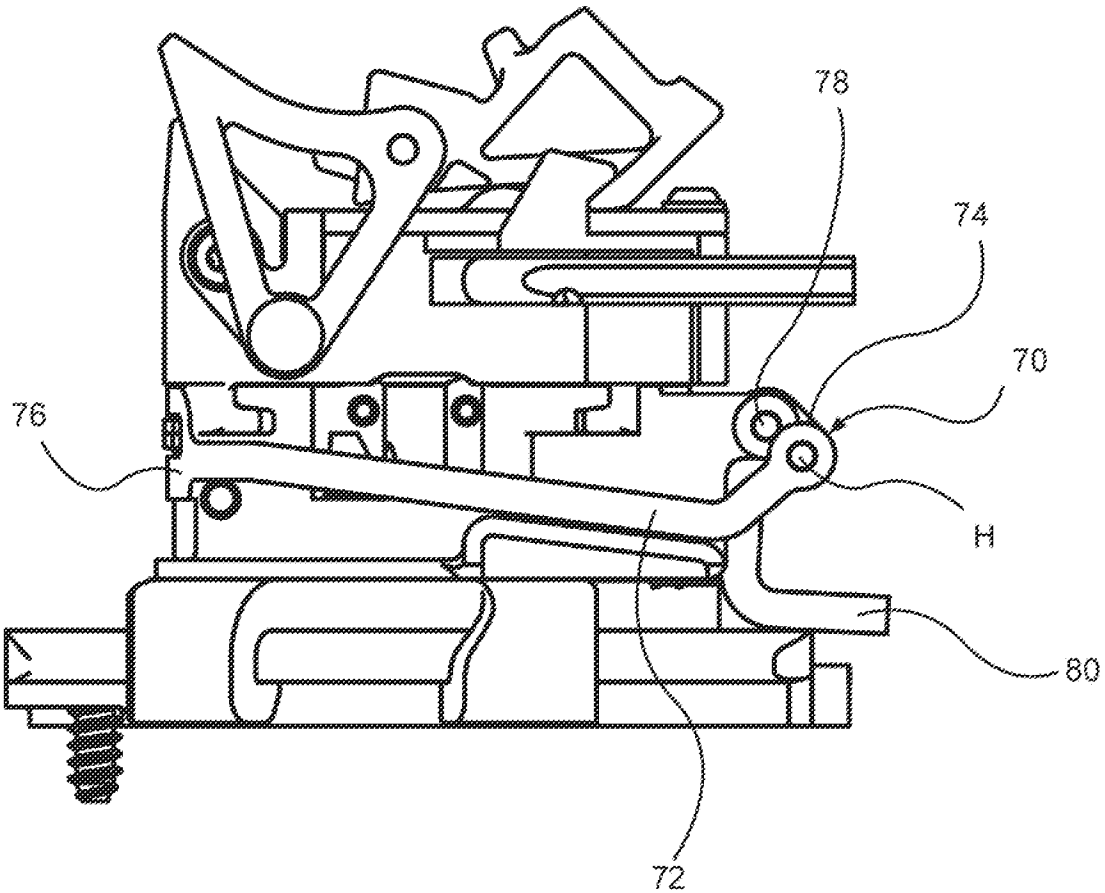
Fig. 6
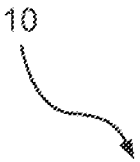

HEEL UNIT COMPRISING A RELEASE AND ADJUSTMENT MECHANISM

CROSS REFERENCE TO RELATED APPLICATION

This application claims priority to German Patent Application No. 10 2020 203 271.8, filed in Germany on Mar. 13, 2020, the entire contents of which are hereby incorporated herein by this reference.

The present invention relates to a heel unit for a touring binding, comprising a base which is intended for mounting on a sliding board, coupling means which are designed to be in engagement with a heel portion of a sliding board boot in a downhill position of the touring binding in order to retain the sliding board boot on the touring binding, a release mechanism by means of which the coupling means are held so as to be movable relative to the base, such that they can be released from the engagement with the sliding board boot, in the downhill position of the touring binding, in the event of action of a force that exceeds a predetermined release force, the release mechanism comprising a spring means which determines the predetermined release force, and an adjustment mechanism by means of which the touring binding is adjustable in a rotatable manner between the downhill position and a walking position in which the coupling means are arranged in a position remote from the sliding board boot, such that they do not come into engagement with the sliding board boot.

Heel units of this kind are known in particular as part of touring ski bindings, in which a touring ski boot is held on a front unit of the binding so as to be pivotable about an axis of rotation extending transversely to the sliding board longitudinal axis. A heel unit of the type mentioned at the outset is arranged in the heel region of the touring ski binding, which heel unit releases the touring ski boot in a walking position, such that it can lift off the boot when going uphill, and retains it in the downhill position, such that the touring ski binding is fixed on the ski.

In order to prevent injury to the skier in the event of a fall during a descent, known touring bindings comprise a release mechanism which releases the sliding board boot when a force acts between the sliding board boot and the touring binding that exceeds a predetermined release force, as is the case in particular in the event of a fall.

The release mechanism and adjustment mechanism of known heel units are usually implemented in that a binding member that carries the coupling means is attached to the base so as to be movable, in particular pivotable about a vertical axis of rotation, and is preloaded by a release spring such that the coupling means are held in the position suitable for engagement with the sliding board boot. The binding is then released by means of movement of the binding member counter to the release spring. An adjustment of the heel unit between the downhill position and walking position is likewise achieved by a movement of the binding member.

In order to allow for a sporty skiing style, and in order to prevent false releases, a sufficiently large release force is desirable. However, this is associated with the problem that a force, to be applied by the user, for adjusting the heel unit between the downhill position and the walking position is accordingly also greater, such that the operation of the heel unit is made more difficult. In this case, lever systems or force conversion assemblies can provide help, which systems or assemblies are in turn, however, again associated with increased design complexity or with an increased weight of the heel unit.

Against this background, the object of the present invention was that of providing a heel unit of a touring binding which allows for the use of higher release forces and at the same time can be operated in a simpler manner, in particular in a manner requiring lower force outlay.

According to the invention, this object is achieved by a heel unit of the type mentioned at the outset, in which the adjustment mechanism comprises an actuation assembly which can be manually actuated by a user between a locking position in which the adjustment mechanism is locked in the downhill position or in the walking position, and an unlocking position in which the adjustment mechanism is unlocked and can be rotated from the downhill position into the walking position or from the walking position into the downhill position substantially without an actuation force or with an actuation force that is less than the predetermined release force.

An important aspect of the solution according to the invention consists in decoupling of the release mechanism and adjustment mechanism by providing a corresponding actuation assembly, such that the adjustment mechanism can be actuated largely independently of the release mechanism, in the unlocked position of the actuation assembly. In this way it is also possible for a force required for adjusting the adjustment mechanism to be provided largely independently of a release force of the release mechanism. The force required for adjusting the adjustment mechanism can then be set, according to the invention, such that it is smaller than the predetermined release force or is even substantially zero (i.e. is only the magnitude of unavoidable friction forces of a movable mechanism). The force required for actuating the actuation assembly from the unlocking position to the locking position or from the locking position to the unlocking position can also be designed independently of the release force, and is then also in particular smaller than the release force or substantially zero. As a result, simple adjustment of the binding between the downhill position and the walking position can be provided, even in the case of a design having a very high release force.

In an advantageous embodiment of the invention, the release mechanism can hold the coupling means, relative to the base, in a rotatable manner, about a release axis of rotation extending orthogonally to the sliding board plane. The release mechanism is then designed in particular for lateral release (Mz release by rotating the sliding board boot about a vertical z-axis). Accordingly, release mechanisms that are known per se, comprising a binding member that is rotatable about a z-axis extending orthogonally to the sliding board plane, can be used in order to construct a heel unit according to the invention.

Alternatively or in addition, the adjustment mechanism can hold the coupling means, relative to the base, in a manner rotatable between the downhill position and the walking position, about an adjustment axis of rotation extending orthogonally to the sliding board plane, such that, in order to adjust the heel unit into the walking position, the coupling means can likewise be moved by a binding member that is known per se and is pivotable about the z-axis. This results in handling of the heel unit that is per se familiar for the user, as well as an operating principle for adjusting the heel unit that is per se proven.

If the release axis of rotation and the adjustment axis of rotation extend in the z-direction (orthogonally to the sliding board plane), then these two axes can be oriented so as to be mutually coaxial, resulting in structural simplifications. Alternatively, the release axis of rotation and adjustment axis of rotation can extend in parallel with one another, at a predetermined spacing, such that the movement paths of the coupling means during the release procedure can be different from the movement paths of the coupling means during the adjustment procedure. This allows for greater design freedom for adjustment to the respective functions. If for example the adjustment axis of rotation is offset slightly to the rear with respect to the release axis of rotation, in the direction of travel of the sliding board, it is thus possible to achieve a binding member, carrying the coupling means, being arranged in a manner eccentric to the adjustment axis of rotation, such that the binding member protrudes further forwards, in the direction of travel, in a downhill position than in the walking position. In this way, a collision between the binding member and the sliding board boot can be reliably prevented, in the walking position.

In a further embodiment of the invention, the heel unit advantageously comprises a first binding member which is movable relative to the base, by means of a release mechanism for a release movement, such that it moves relative to the base, in the downhill position of the touring binding, upon action of a force that exceeds the release force, and is retained relative to the base, with respect to the release movement, upon action of a force that does not exceed the release force, a second binding member which carries the coupling means which is movable relative to the first binding member by means of the adjustment mechanism. In this way, a separate second binding member is provided for retaining the coupling means, as a result of which the decoupling of the release mechanism can be achieved in a structurally simple manner. Furthermore, a My-release mechanism that is known per se can be arranged in the second binding member, which release mechanism preloads the coupling means towards one another, in a plane extending in parallel with the sliding board plane, with a My-release force, such that release of the sliding board boot towards the top is ensured even in the event of a forwards fall.

Preferably, the first binding member is movably mounted on the base, and/or the second binding member is movably mounted on the first binding member, such that a structurally simple design results. In a variant of the invention having improved mechanical stability, the first binding member may be movably mounted on the base on a first bearing, and the second binding member may be movably mounted on the base on a second bearing that is separate from the first bearing.

In one embodiment of the heel unit comprising two binding members it is possible in particular for a relative movement between the first binding member and the second binding member to be blocked, in the locking position of the actuation assembly, and for a relative movement between the first binding member an the second binding member to be made possible substantially without an actuation force or with an actuation force that is smaller than the predetermined release force, in the unlocking position of the actuation assembly. In this case, the advantages according to the invention can be achieved in a simple manner in that a relative movement between the first and second binding member is allowed or blocked by means of the actuation assembly. Such locking or unlocking can be achieved by a form-fitting connection, i.e. in that for example a projection of one of the elements from the first binding member, second binding member and actuation assembly engages in a matching recess of another element from the first binding member, second binding member and actuation assembly.

The actuation assembly can be designed to allow a displacement between the first binding member and the second binding member, in the unlocking position, preferably to allow a displacement in a direction extending orthogonally to the release axis of rotation and/or to the adjustment axis of rotation, and to block the displacement in the locking position. In particular, said displacement between the locking position and the unlocking position can take place, the binding members being positioned relative to one another, in the locking position, such that the adjustment mechanism is blocked, while the binding members are positioned relative to one another, in the unlocking position, such that they can move relative to one another, for the purpose of adjusting the touring binding between the downhill position and the walking position. If the adjustment movement is a rotational movement, the two binding members can be displaced into such a position, in the locking position, that, on account of a form-fitting mutual engagement, they are not rotatable relative to one another, while the two binding members are freely twistable relative to one another in the unlocking position. In the last-mentioned embodiment, the actuation assembly can be pivotably attached to the heel unit, it being possible for a hinge mechanism to be provided which converts a pivot movement of the actuation assembly into a translational movement between the first binding member and the second binding member. The pivot movement allows for simple handling, while the hinge mechanism allows for a relatively high force transmission for displacement of the binding members relative to one another.

According to a further embodiment of the invention, the actuation assembly is pivotably attached to the heel unit by means of a dead-center mechanism, such that it is preloaded towards the locking position, in the locking position, and passes through a dead center, in the case of a movement towards the unlocking position, in which dead center the direction of the preload reverses. By means of the dead-center mechanism, the actuation assembly, in particular in the locking position, i.e. when using the heel unit for walking or travelling downhill, is retained under a preload by a spring effect of the dead-center mechanism, such that the actuation assembly is held in the locking position without play, and for example cannot clatter.

In a further embodiment of the present invention, the actuation assembly can be held on the heel unit so as to be displaceable between the locking position and the unlocking position, preferably held so as to be displaceable in a direction in parallel with the sliding board longitudinal axis. In particular in combination with a binding member that is rotatable about an axis of rotation, a displaceable actuation assembly can provide particularly stable, form-fitting locking. In an alternative embodiment, the actuation assembly can be held on the heel unit so as to be pivotable between the locking position and the unlocking position, preferably held so as to be pivotable about a pivot axis extending in parallel with the sliding board plane and orthogonally to the sliding board longitudinal axis. A pivotable actuation assembly can in particular be resistant to outside mechanical influences from ice, snow, and dirt.

In preferred variants of the invention, the actuation assembly can comprise a boot contact portion which, in a downhill position of the heel unit, comes into resting contact with a heel portion of the sliding board boot held at the coupling means, the actuation assembly being designed such that a force acting on the boot contact portion in a direction directed away from the sliding board boot pushes the actuation assembly and/or the adjustment mechanism into the locking position or holds it in the locking position. In this way, a force input into the second binding member by the sliding board boot, via the coupling means, during a descent always acts in the direction of a locking of the actuation assembly or the adjustment mechanism, such that unintentional adjustment of the heel unit can be reliably prevented.

It is thus possible for example for the above-mentioned displacement of the second binding member relative to the first binding member to preferably be designed such that the second binding member moves backwards in the sliding board longitudinal direction, i.e. away form the sliding board boot (in a direction opposite to the direction in which the coupling means protrude), in the case of a movement from the unlocking position to the locking position. Thus, during use of the heel unit, the sliding board boot pushes the second binding member into the locking position.

Figure 2:
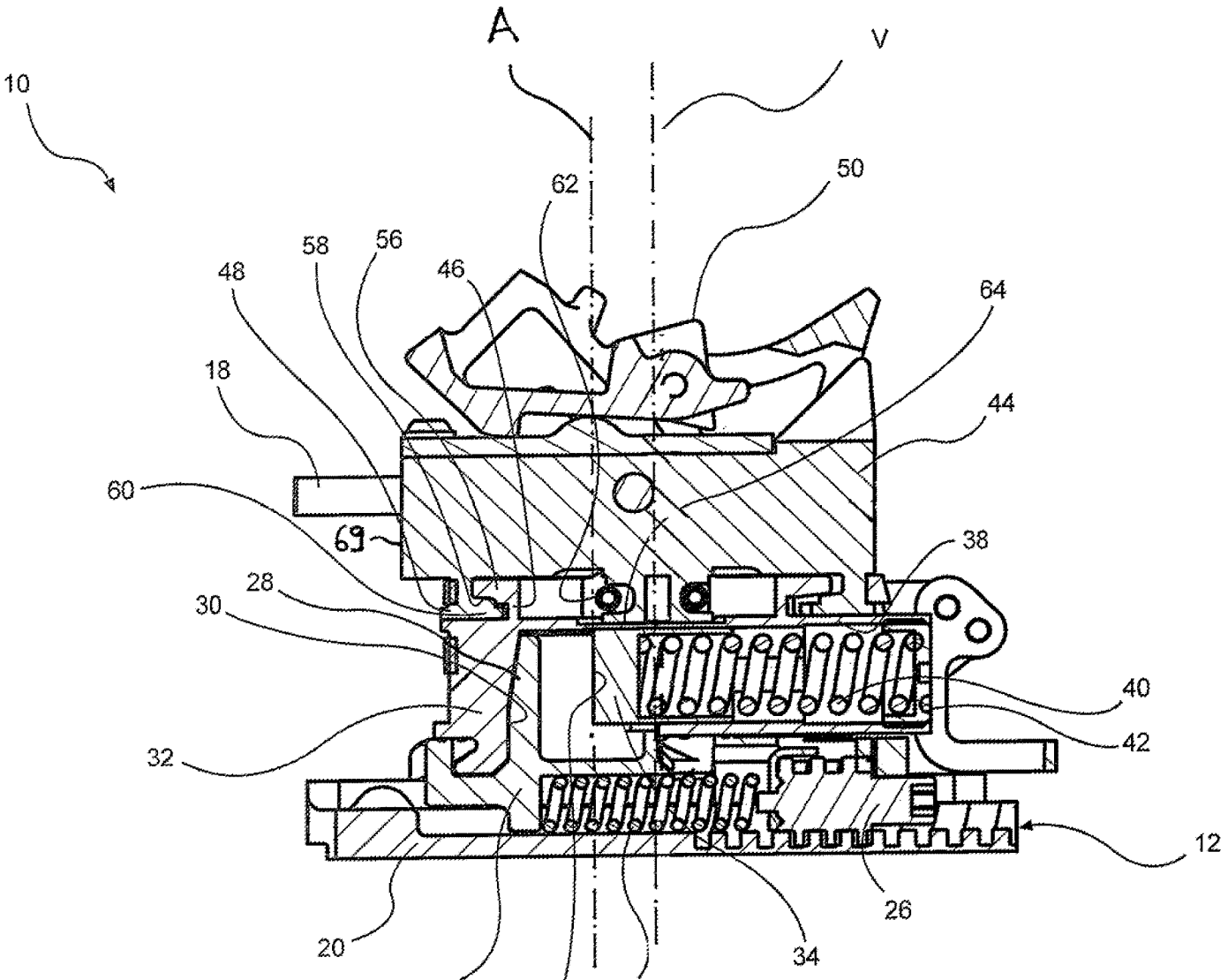
Figure 3:
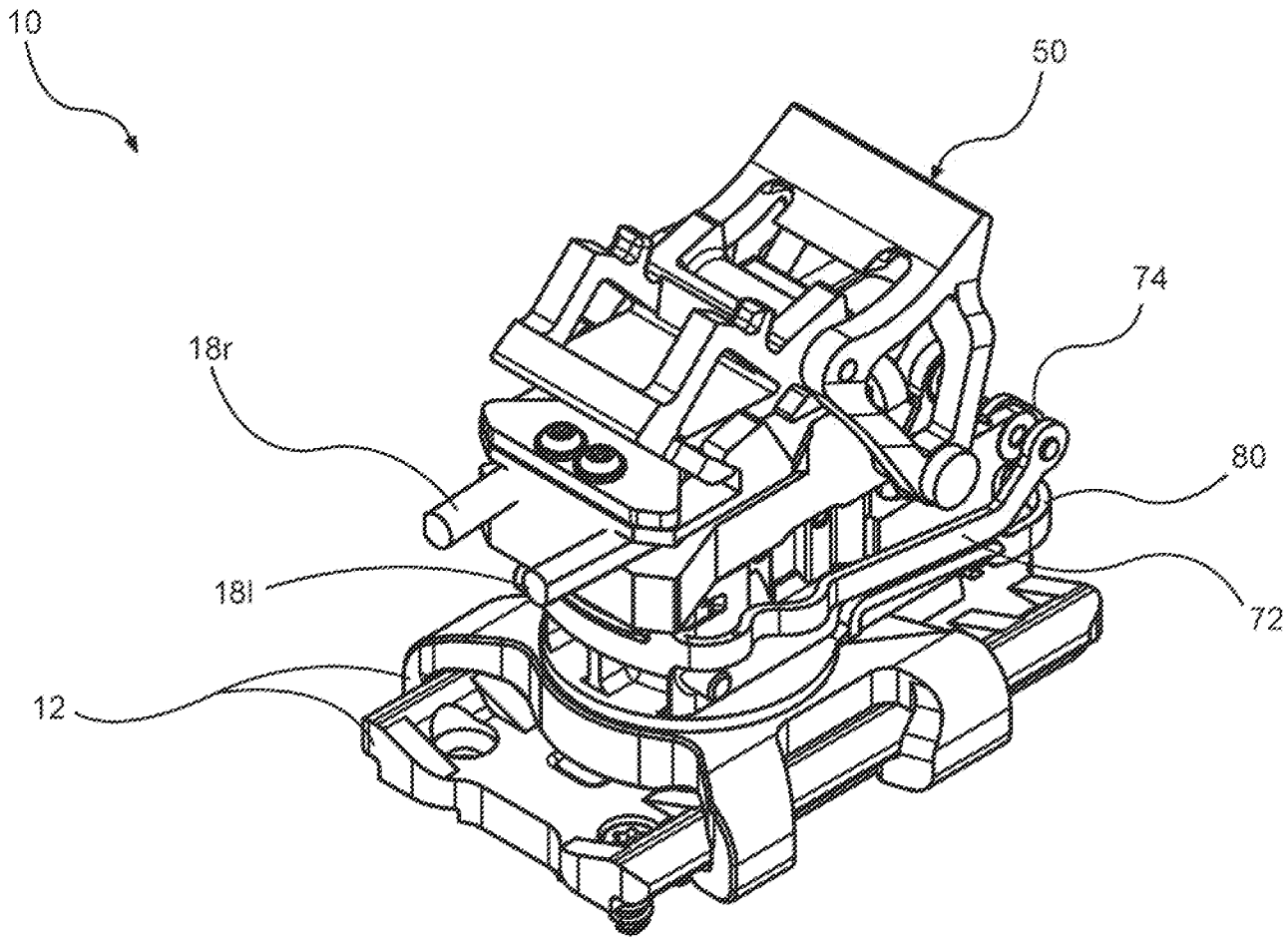
Figure 4:
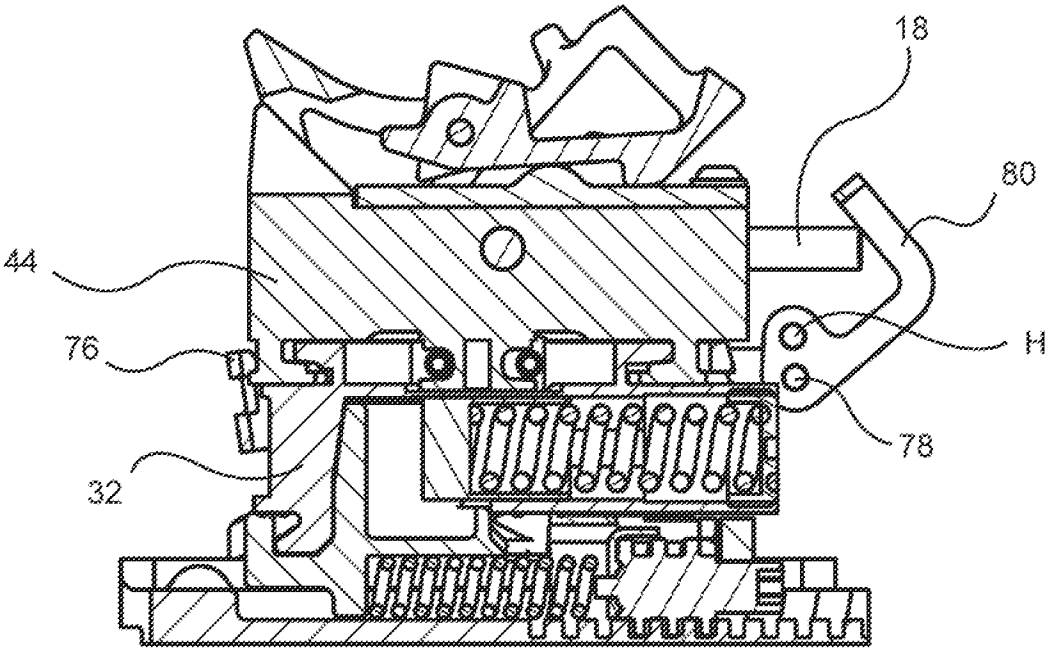
Figure 7:
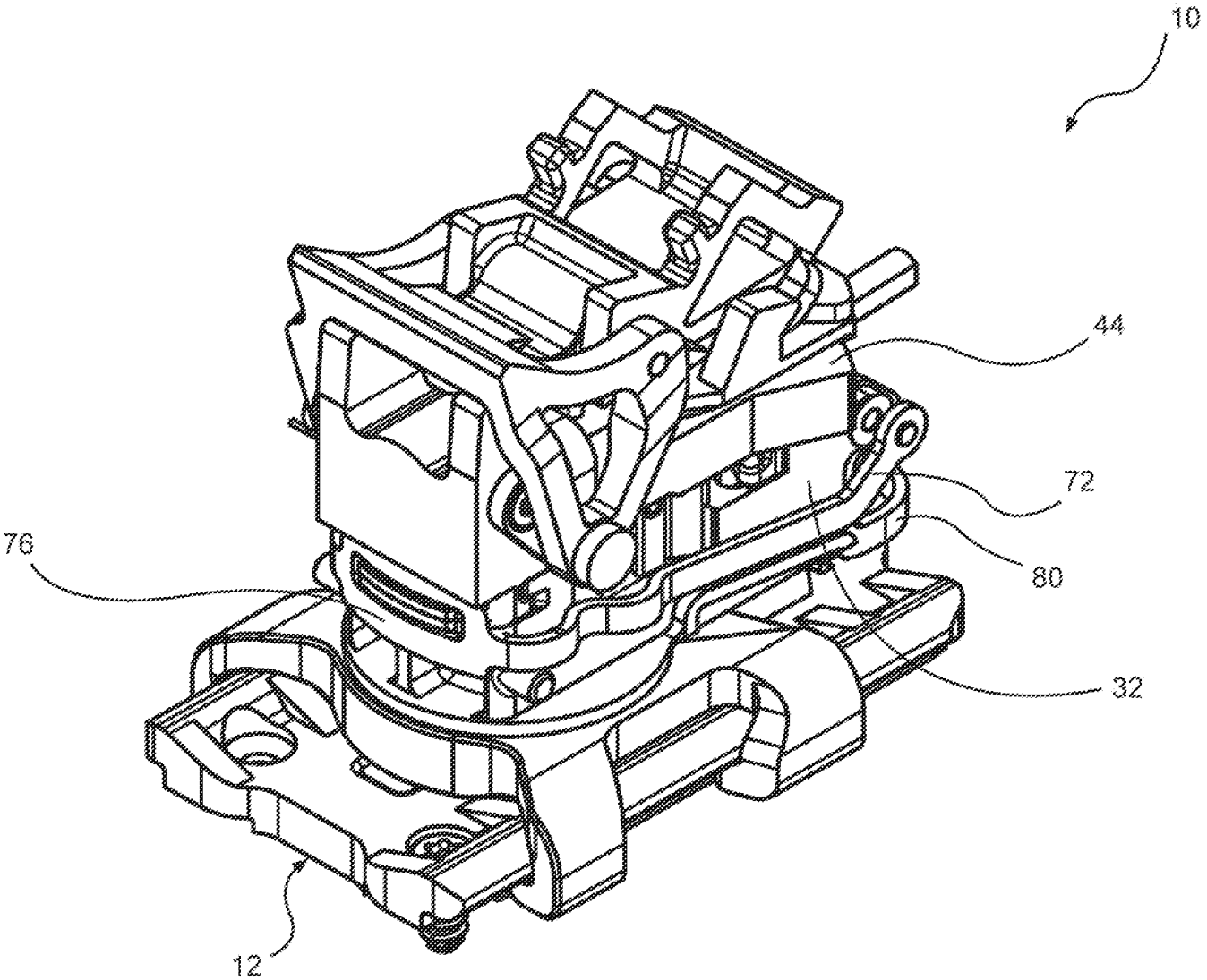
Figure 8:
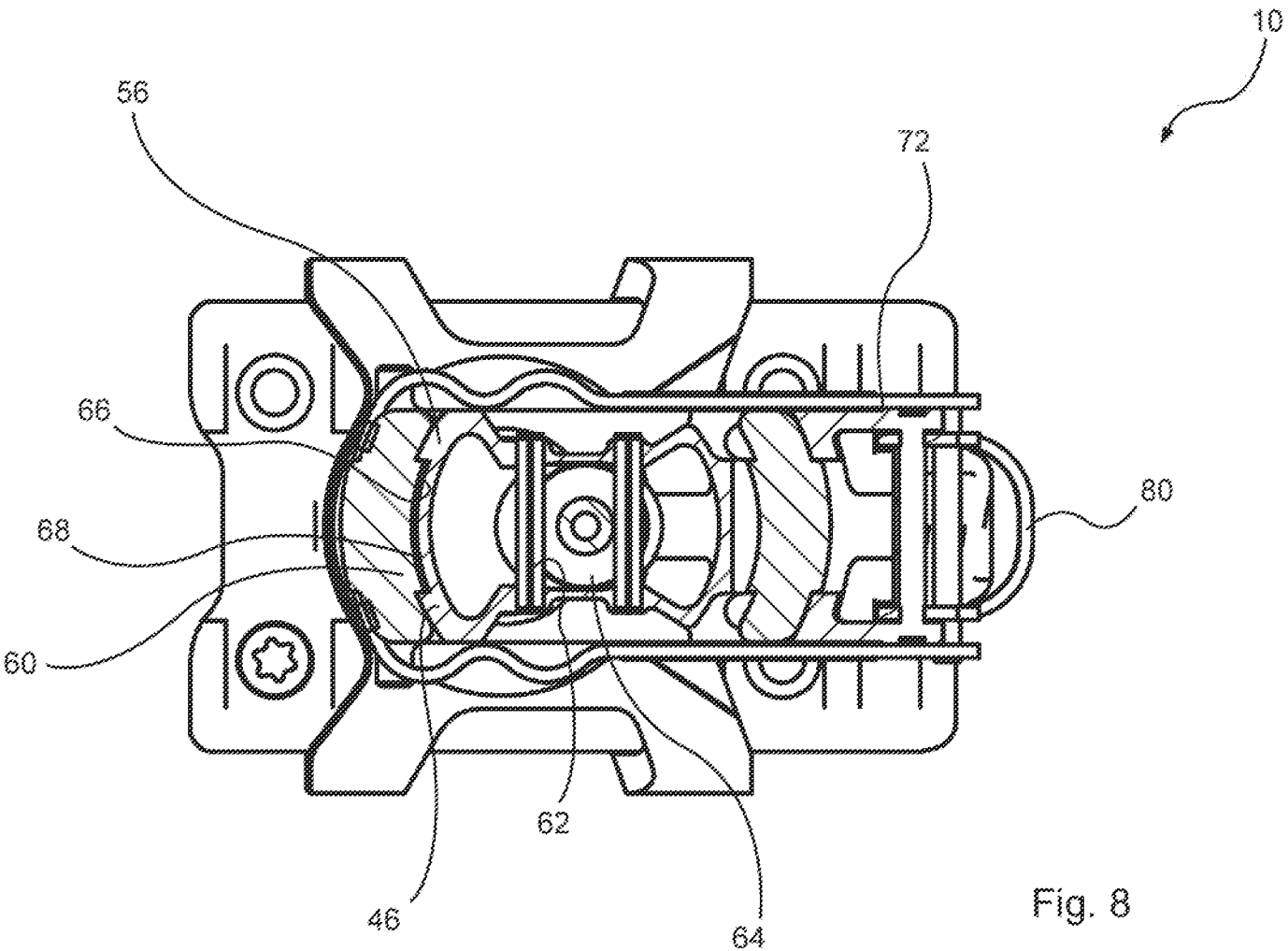
Figure 9:
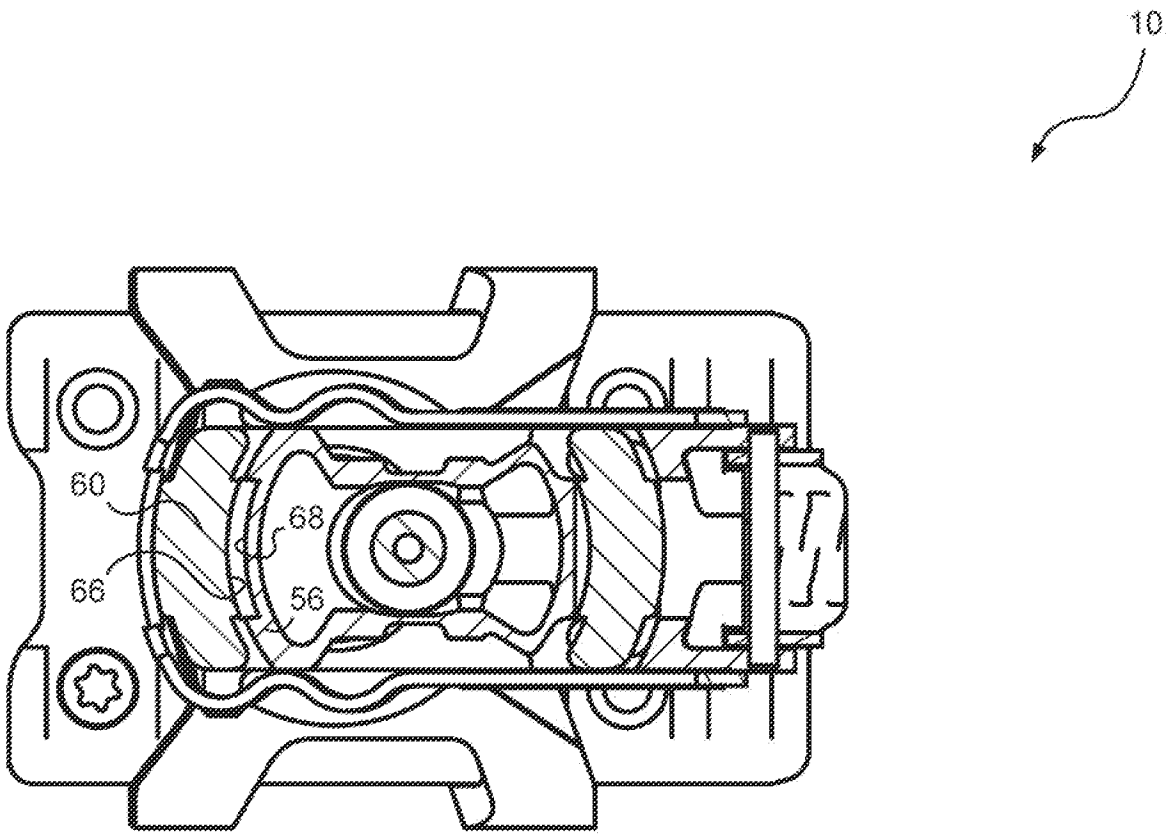
Figure 10B:
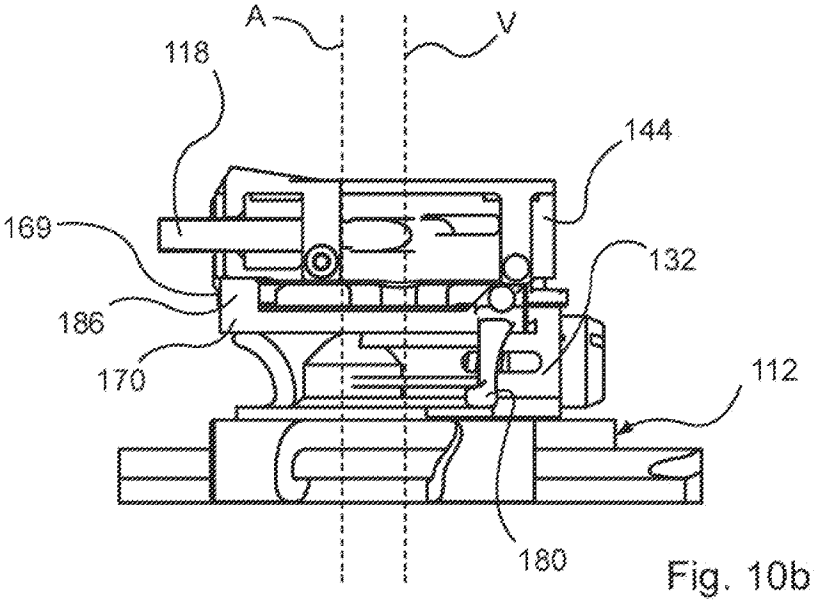
Figure 10A:
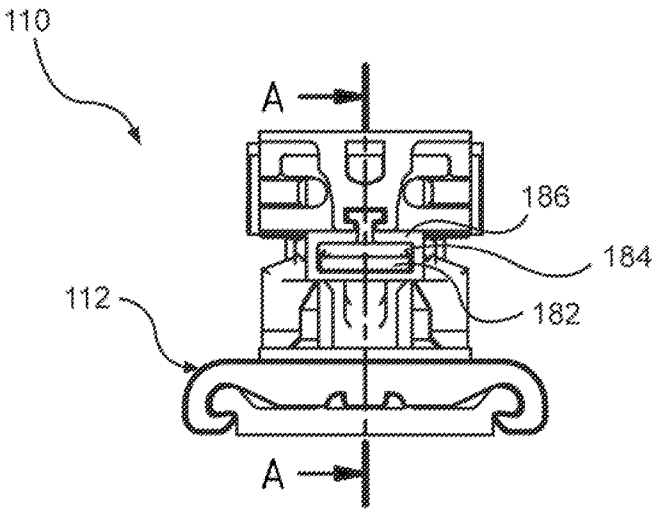
Figure 10C:
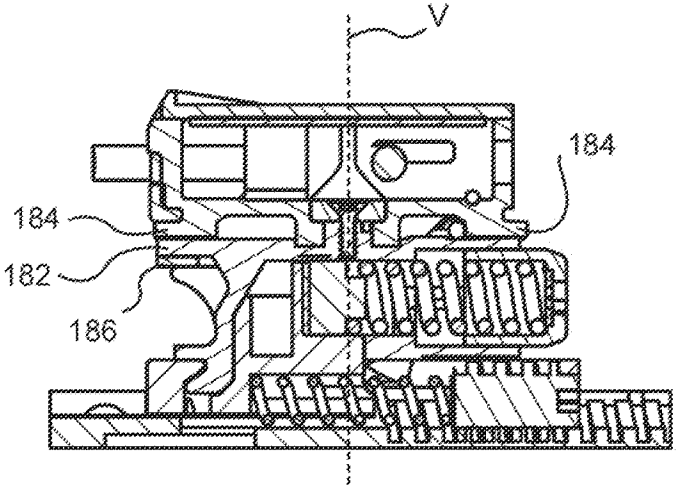
Figure 11B:
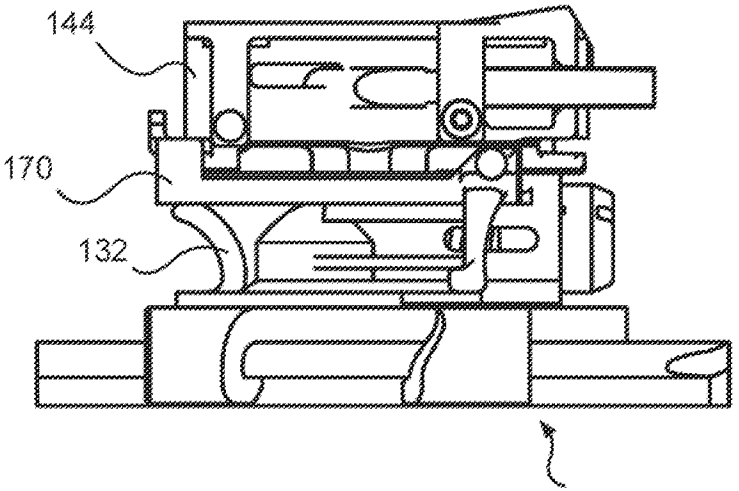
Figure 11A:
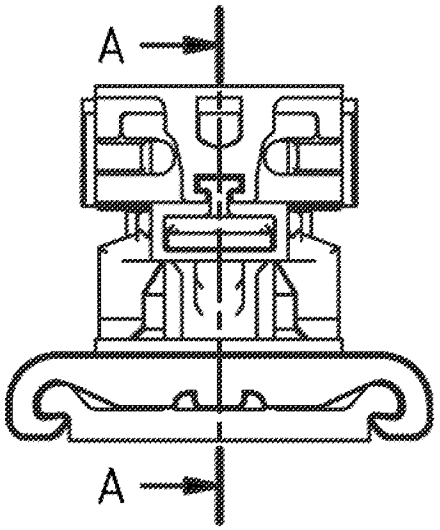
Figure 11C:
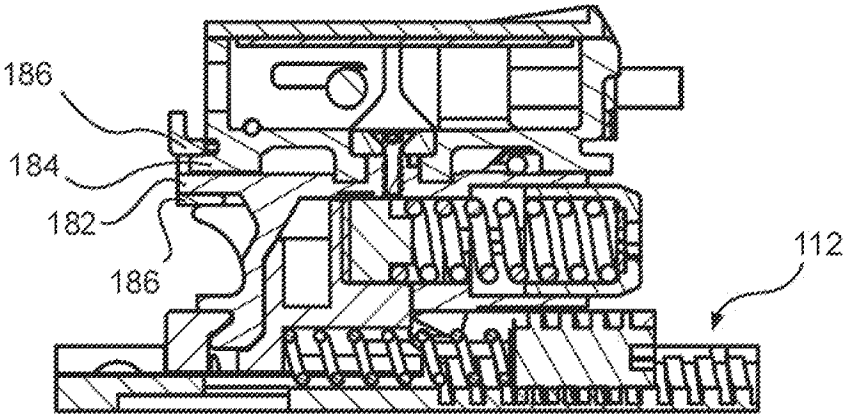
Figure 12B:
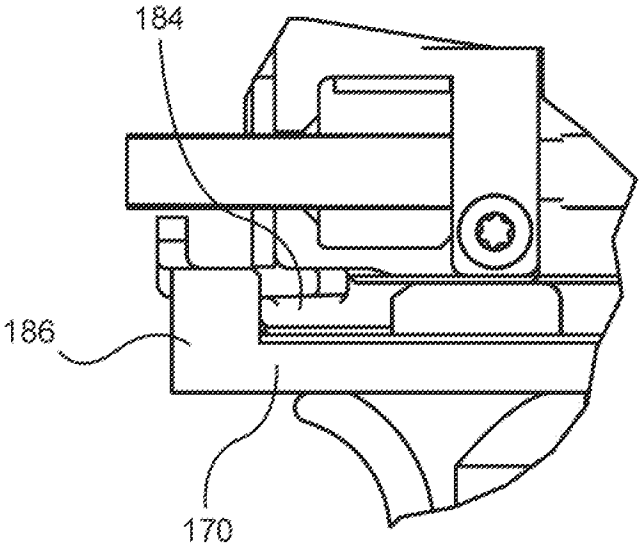
Figure 12A:
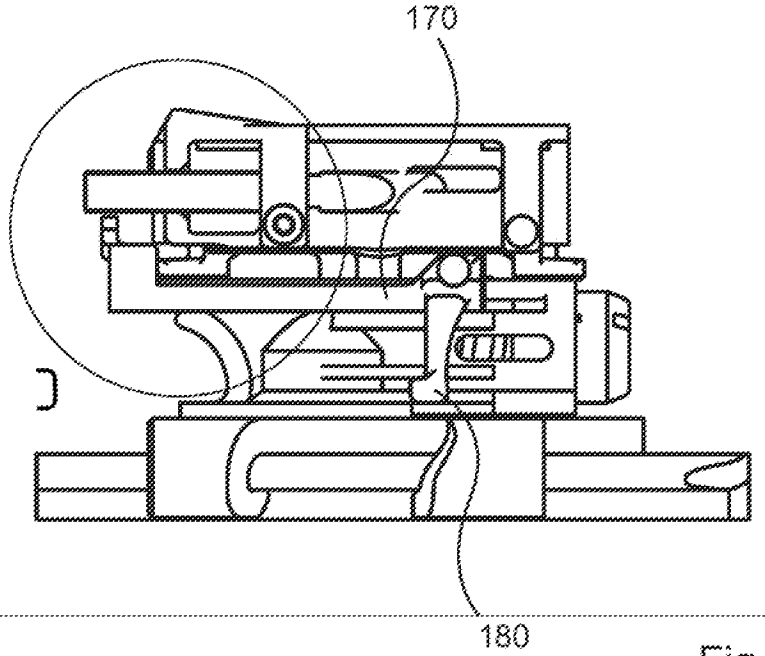
Figure 13B:
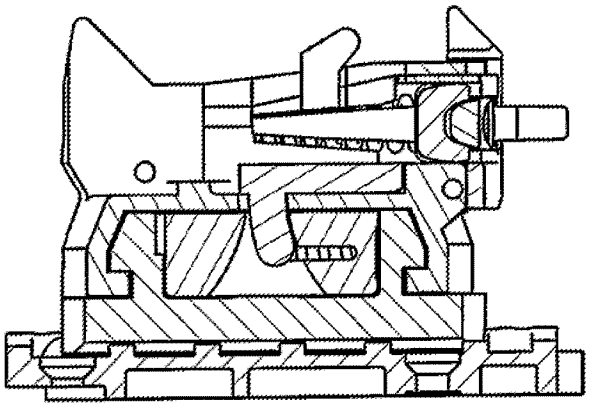
Figure 13A:
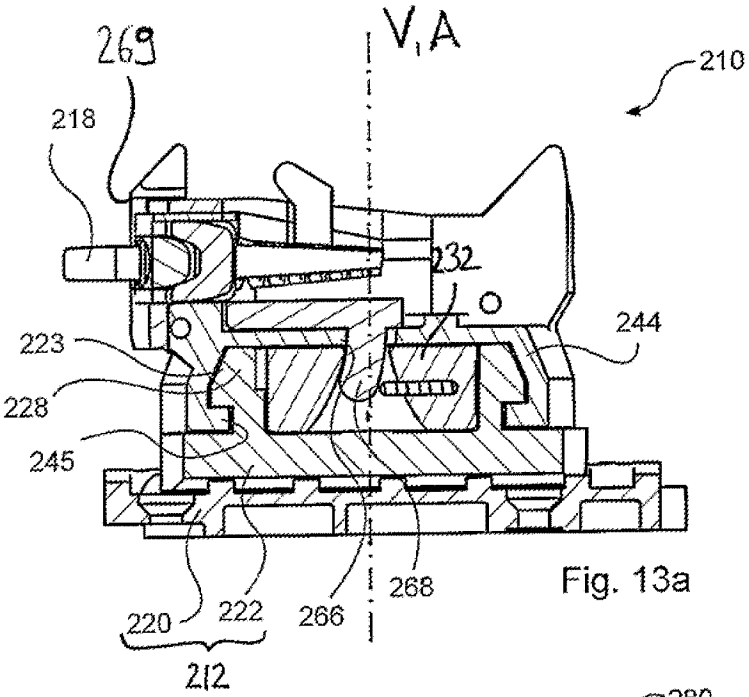
Figure 13C:
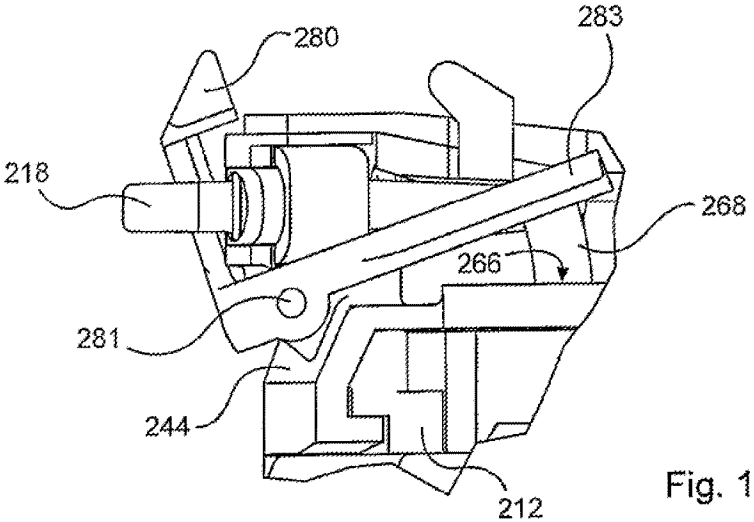
Figure 13E:
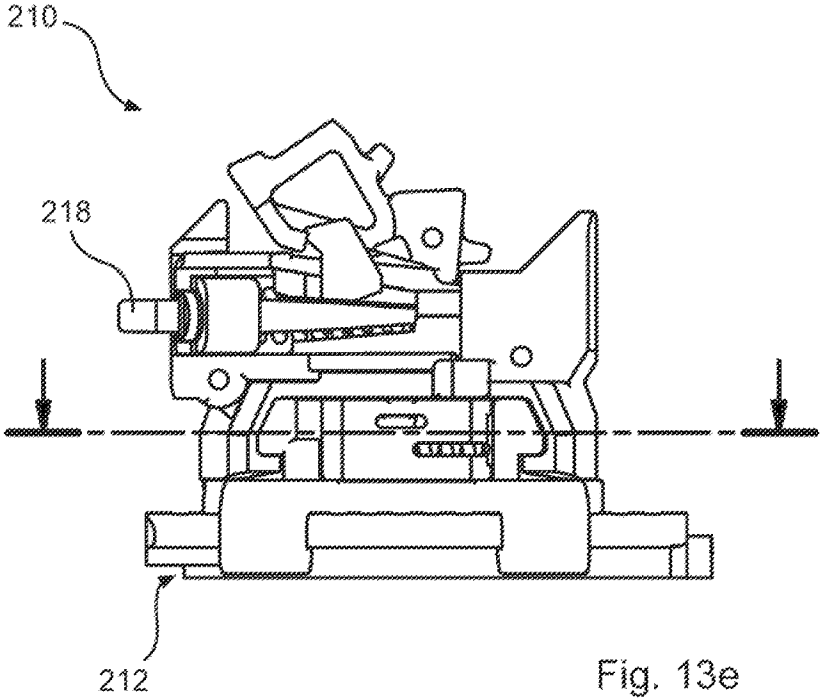
Figure 13D:
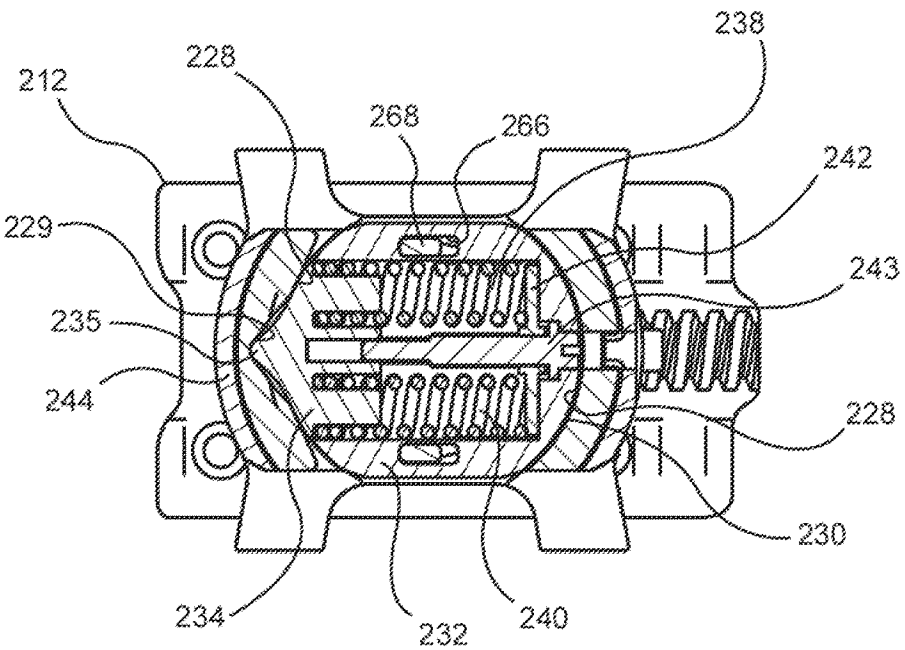

The invention will be explained in greater detail in the following, with reference to preferred embodiments and the accompanying drawings, in which:

FIG. 1 is a side view of a heel unit according to a first embodiment of the present invention, in a downhill position, FIG. 2 is a longitudinal sectional view of the heel unit of the first embodiment, in a locked downhill position, FIG. 3 is a perspective view of the heel unit of the first embodiment, in a locked downhill position, FIG. 4 is a longitudinal sectional view of the heel unit of the first embodiment, in an unlocked walking position, FIG. 5 is a longitudinal sectional view of the heel unit of the first embodiment, in a locked walking position, FIG. 6 is a side view of the heel unit of the first embodiment, in a locked walking position, FIG. 7 is a perspective view of the heel unit of the first embodiment, in a locked walking position, FIG. 8 is a sectional view, in the horizontal cutting plane, of the heel unit of the first embodiment, in the locked downhill position, FIG. 9 is a sectional view, in the horizontal cutting plane, for a heel unit of the first embodiment, in the unlocked downhill position, FIG. 10*a-c* are a front view, a side view, and a longitudinal sectional view, respectively, of a heel unit according to a second embodiment of the present invention, in a locked downhill position, FIG. 11*a-c* are a front view, a side view, and a longitudinal sectional view, respectively, of the heel unit of the second embodiment in a locked walking position, FIGS. 12*a* and 12*b* are a side view of the heel unit of the second embodiment in an unlocked downhill position, shown in a side view (FIG. 12*a*) and in an enlarged view of a detail C from FIG. 12*a* (FIG. 12*b*), FIG. 13*a* is a longitudinal sectional view of a heel unit according to a third embodiment of the present invention, in a locked downhill position, FIG. 13*b* is a longitudinal sectional view of the heel unit of the third embodiment, in the locked walking position, FIG. 13*c* is a detail view of a front portion of the heel unit of the third embodiment, in a side view, for the unlocked downhill position, FIG. 13*d* is a sectional view of the heel unit of the third embodiment, in a cutting plane marked by arrows in FIG. 13*e*, and FIG. 13*e* is a side view of the heel unit of the third embodiment, in the locked downhill position.

A heel unit, denoted in a general manner by 10 in FIGS. 1 to 9, of a first embodiment of the invention, comprises a base 12 for fastening the heel unit 10 to a sliding board (not shown). A fastening assembly of the base 12, e.g. fastening screws 14 and a lower contact surface 16 of the base 12, define a sliding board plane E corresponding to a surface of the sliding board on which the heel unit 10 is to be mounted. The base 12 furthermore defines a sliding board longitudinal direction or x-axis, which is oriented in the direction of travel of the sliding board, and a y-axis extending orthogonally to the x-axis and in parallel with the sliding board plane E, as well as a z-axis extending orthogonally to the sliding board plane E.

The heel unit 10 comprises coupling means 18 for coupling to a touring ski boot 11, in order to retain the touring ski boot 11 in the downhill position of the heel unit 10. In a manner known per se, the coupling means 18 can be formed by two coupling pins 181, 18*r* extending substantially in the x-direction, which pins extend in a plane in parallel with the sliding board plane E and protrude forwards, from the heel unit 10, in the downhill position. The coupling pins 181, 18*r* can be separate pins or ends of a U-shaped bracket. In a manner known per se, the coupling pins 181, 18*r* are preferably preloaded into the position thereof ready for engagement, by means of a My-release mechanism, such that they retain the heel portion of the touring ski boot 11. When a predetermined release force is overcome, the coupling pins 181, 18*r* can be moved away from one another in the y-direction, said movement taking place counter to the effect of a My-release spring. Examples for such a release mechanism are known from EP 2 545 966 A2 or EP 0 199 098 A2, the content of which with respect to said release mechanism is intended to be incorporated in full in this disclosure. Alternatively, the coupling pins 181, 18*r* can be formed by the front ends of a U-shaped bracket element, which element is retained on the heel unit 10 such that the two coupling pins 181, 18*r* are movable by means of resilient deformation of the U-shaped bracket element, in order to allow for a My-release of the heel unit 10.

The base 12 can be formed in two parts, comprising a first base element 20 which comprises for example the fastening assembly for fastening by means of screws 14, for fastening to the sliding board (corresponding bores in the first base element 20), and comprising a second base element 22 which can be attached to the first base element 20. The second base element 22 can be retained on the first base element 20 so as to be displaceable in the x-direction, in order to allow for longitudinal positioning of the heel unit 10 for adjustment to a boot size, and/or in order to allow a certain mobility of the heel unit 10 relative to the sliding board, along the x-axis, in a predetermined dynamic movement range. In the latter case, the heel unit 10 can be movable in the x-direction, counter to a force of a pressure spring, and thus be pressed into contact with a touring ski boot 11, while a spacing between the front unit and heel unit 10 of the binding changes slightly when passing over ground unevenness. In the embodiment shown, both a certain mobility counter to a pressure spring 24, and setting of the position of the heel unit 10 for adjustment to a boot size are provided by adjustment of an adjustment screw 26. The adjustment screw 26 can in particular be retained on one of the two elements of the first base element 20 and the second base element 22 so as to be rotatable but axially not displaceable, while it is guided in threaded engagement at the second element of the first base element 20 and second base element 22.

The base 12, in particular the second base element 22, preferably comprises a first bearing portion 28, on which a first counter bearing portion 30 of a first binding member 32 is mounted, such that the first binding member 32 can rotate, relative to the base 12, about a release axis of rotation A extending in the z-direction. The rotational movement between the first binding member 32 and the base 12 can be controlled by an Mz-release mechanism that is known per se, comprising a cam body 34 that is displaceably retained on the first binding member 32, and a cam surface 36 which is provided on the second base element 22. A release spring 40, received in a receptacle 38 of the first binding member 32, then preloads the cam body 34 in resting contact against the cam surface 36. The release spring 40 is preferably supported, relative to the first binding member 32, both on the cam body 34, and on a spring stop 42 of the spring receptacle 38. The spring stop 42 is preferably displaceable in the effective direction of the release spring 40, for example in threaded engagement with the first binding member 32, such that it is possible to set a preload of the release spring 40 for changing the release force.

If the first binding member 32, and thus also the spring receptacle 38, the release spring 40 and the cam body 34, are rotated relative to the base 12, the cam body 34 thus slides on the cam surface 36. The shaping of the cam surface 36, in particular a flat portion, makes it possible for a rotational movement of the first binding member 32 out of the downhill position shown in FIG. 2 (in which the coupling means 18 face forwards, substantially in the x-direction) to be associated with compression of the release spring 40, and therefore to require the release force defined by the release spring 40 to be overcome.

The cam surface 36 can comprise a second flat portion which is associated with a second rotational position of the binding member 32 relative to the base 12, in particular a walking position shown in FIGS. 4 to 6, such that the release spring 40 can stabilize the rotational movement of the first binding member 32, even in the walking position.

The heel unit 10 further comprises a second binding member 44 which is mounted on the first binding member 32 so as to be rotatable about an adjustment axis of rotation V. For this purpose, the first binding member 32 can comprise a second bearing portion 46, on which a second counter bearing portion 48 of the second binding member 44 is mounted. The adjustment axis of rotation V preferably extends, at a spacing, in parallel with the release axis of rotation A, but can alternatively also be arranged so as to be coaxial to A. The coupling means 18 and optionally a My-release mechanism of the type described above are retained at the second binding member 44.

Furthermore, the second binding member 44 can carry a heel lifter assembly 50 which is known per se, for example comprising a first heel lifter 52 which is mounted on the second binding member 44 so as to be pivotable about a first swivel pin S1 extending in the y-direction, in order to be pivoted between an inactive position (shown in the drawings) and an active position (not shown in the drawings) entering the movement range of the touring ski boot 11. In order to achieve different heights of the support of the touring ski boot 11, a second heel lifter 54 can additionally be provided, which heel lifter is likewise pivotable about a swivel pin S2 between an inactive position and an active position. The swivel pin S2 can be identical to the swivel pin S1, but can likewise, as shown in the illustrated embodiment, be a second swivel pin S2 extending at a spacing from S1 and in parallel with S1. In particular, the second swivel pin S2 can be arranged on the first heel lifter 52, or can likewise be arranged on the second binding member 44.

With reference to FIGS. 2, 8 and 9, the second bearing portion 46 and the second counter bearing portion 48 for rotatable mounting of the second binding member 44 on the first binding member 32 will be explained in greater detail. In the embodiment shown, the second bearing portion 46 provided on the first binding member 32 comprises a first projection 56, in particular an outer annular projection, which protrudes with respect to the adjustment axis of rotation V, in the radial direction, and as a result forms an undercut 58 between it and the first binding member 32. Said undercut engages behind a second projection 60 of the second counter bearing portion 48 of the second binding member 44, preferably also formed by an annular projection, such that the second binding member 44 is retained on the first binding member 32 in an axially immovable manner, but can in principle rotate about the adjustment axis of rotation V, with respect to the first binding member 32.

Furthermore, the first binding member 32 can comprise a third projection 62, formed in this case by a pin extending in parallel with the sliding board plane, which engages behind a fourth projection 64 of the second binding member 44, such that a second bearing is formed which retains the second binding member 44 on the first binding member 32 so as to be axially immovable but so as to be rotatable about the adjustment axis of rotation V.

The first and second projection 56, 60 can each be formed as partial rings or partial annular projections, such that they engage in one another only if the heel unit 10 is positioned in the downhill position and/or the walking position, or a rotational position adjacent to the respective positions. The first projection 56 and the second projection 60 can then come out of engagement in the rotational angle range between the downhill position and the walking position, such that the second binding members 44 are held against one another only by the third projection 62 and the fourth projection 64. In this way it is possible to further reduce a force for twisting the second binding member 44 relative to the first binding member 32, over a large part of the rotational angle, while at the same time the bearing between the first and second projection 56, 60, arranged radially relatively further outside, ensures stable and precise relative positioning between the binding members 32, 44, in a rotational angle range close to the downhill position and/or close to the walking position.

A relative rotation between the first binding member 32 and the second binding member 44 is, however, only possible in an unlocking position shown in FIG. 9, while it is blocked in a locking position shown in FIG. 8. The second binding member 44 is preferably displaceable in the x-direction, relative to the first binding member 32, between the unlocking position and the locking position. In order to achieve the locking position, in the embodiment shown a first latching contour 66 (a serration, a projection or a recess) is provided on the second projection 60, while a complementary second latching contour 68 (serration, projection or recess matching the first latching contour 66) is provided on the first annular projection 56 of the second bearing portion 46. The elements of the second bearing portion 46 and of the second counter bearing portion 48, in particular the projections 56, 60, 62, 64, are designed such that they allow a displacement between the second binding member 44 and the first binding member 32 in the x-direction, to the point that the projections 56, 60, 62 and 64 are still in form-fitting contact with one another in the axial direction, but the latching contours 66, 68 can be brought into engagement with one another or released from the engagement.

With reference to FIGS. 6 to 9, an actuation assembly 70 is described, which is designed to control the movement, described above, of the second binding member 44 relative to the first binding member 32, in the x-direction, between the locking position and unlocking position. In the embodiment, the actuation assembly 70 in particular comprises a first lever 72 and a second lever 74, which are hingedly interconnected at a lever axis H. The first lever 72 can be coupled to the second binding member 44, at a first coupling portion 76, at a spacing from the lever axis H. The second lever 74 can be coupled to the first binding member 32, at a second coupling portion 78, at a spacing from the lever axis H. As can be seen in particular in FIG. 6, the first coupling portion 76, second coupling portion 78 and lever axis H form a triangle, such that, in the event of a change in the angle between the first lever 72 and the second lever 74, the spacing between the first coupling portion 76 and the second coupling portion 78, and thus a relative position between the second binding member 44 and the first binding member 32, will change.

Advantageously one of the two levers, in the embodiment the second lever 74, comprises an actuation portion 80 which extends one of the lever arms and by means of which the first lever 72 and the second lever 74 are movable, in order to adjust the actuation assembly 70 between the locking position and unlocking position. In this case, the actuation assembly 70 is constructed such that the actuation assembly 70 passes through a dead center position in an intermediate portion of the movement path of the actuation portion 80 between the locking position and unlocking position, in which dead center position the first coupling portion 76, the second coupling portion 78, and the lever axis H are arranged substantially on a common line. In said dead center position, the relative displacement between the first binding member 32 and the second binding member 44 reaches a maximum, in particular a value of a maximum contact pressure between the first latching contour 66 and the second latching contour 68, as a result of which a resilient counterforce is generated, by means of which the actuation assembly 70** is preloaded in the direction of the respective locked or unlocked positions thereof, on either side of the dead center position.

A front edge in the downhill position (edge facing towards the touring ski boot 11 in the x-direction) can form a boot contact portion 69, on which a heel portion of the touring ski boot 11 can rest in the downhill position (see FIG. 1). It can be seen that a force F, which possibly acts from the touring ski boot 11 into the heel unit in the case of descent, is oriented counter to the direction of travel, in the x-direction, and pushes the second binding member 44 towards the rear (in direction F). The second binding member 44 is therefore pushed into or held in the locking position (e.g. FIG. 8) during use of the heel unit 11.

In the locked walking position shown in FIG. 6, and in the locked travel position shown in FIG. 8, in each case the first lever 72 pulls the second binding member 44 towards the right, in the drawings, and thus pulls the first latching contour 66 into latching engagement with the second latching contour 68, such that a rotational movement between the first and second binding member 32, 44 about the adjustment axis of rotation V is blocked in a form-fitting manner. This means that the coupling means 18 can twist to one of the two sides only if the first and second binding members 32, 44 rotate together, relative to the base 12, about the release axis of rotation A. This movement is achieved counter to the force of the release spring 40, upon overcoming the release force.

If, in contrast, the actuation portion 80 is pivoted into the unlocking position according to FIG. 4 (pivoted upwards, in the drawings), the actuation assembly 70 allows for displacement of the second binding member 44 relative to the first binding member 32, such that the second binding members 44 are displaced to the left in the drawings, until the second latching contour 68 is retracted completely out of engagement with the first latching contour 66 (see FIG. 9). In this position, the second binding member 44 can twist relative to the first binding member 32, about the adjustment axis of rotation A, in order to move the coupling means 18 between the downhill position and walking position. In this adjustment movement, the first binding member 32 remains rotationally fixed relative to the base 12, such that merely the frictional forces between the second bearing portion 46 of the first binding member 32 and the second counter bearing portion 48 of the second binding member 44 counteract the rotational movement of the second binding member 44. Accordingly, the actuation force for adjusting the second binding member 44 is independent of the release force determined by the release spring 40, and can in particular be very low or, apart from unavoidable friction forces, even zero. As a result, a substantially force-free and thus very comfortable option for adjusting the heel unit between the downhill position and the walking position is made possible.

Following the adjustment of the heel unit 10, the actuation assembly 70 is again brought into the locking position, such that the locking position is always present, in the case of use of the heel unit 10 in the walking position or in the downhill position. In the embodiment, an adjustment of the heel unit 10 between the downhill position and walking position corresponds to a rotational movement of the second binding member 44 relative to the first binding member 32, about an angle of 180°. This means that the coupling means 18 point forwards, in the x-direction, in the downhill position, while they point backwards, in the x-direction, in the walking position.

A second embodiment of the invention will be described in greater detail in the following, with reference to FIGS. 10*a* to 12*b*. In this case, only the differences with respect to the first embodiment will be discussed in greater detail, and otherwise reference is made to the description of the first embodiment. All the features and functions of the first embodiment, which are not described again here, can also be transferred, in the same or in a corresponding manner, to the second embodiment.

A heel unit 110 of the second embodiment also comprises a first binding member 132 which is mounted on a base 112 so as to be rotatable about a release axis of rotation A, and a second binding member 144 which is mounted on the first binding member 132 so as to be rotatable about an adjustment axis of rotation V. The adjustment axis of rotation V and release axis of rotation A extend in the z-direction, the adjustment axis of rotation V preferably being arranged so as to be at a spacing behind the release axis of rotation A, with respect to the x-direction.

In the second embodiment, an actuation assembly for locking or unlocking the adjustment movement comprises a slide 170 which is mounted so as to be displaceable between the locking position and the unlocking position, in particular in the x-direction. The slide 170 can comprise an actuation portion 180 for a user. The slide 170 advantageously establishes a form-fitting coupling between a first locking portion 182 of the first binding member 132, a second locking portion 184 of the second binding member 144, and a third locking portion 186 of the slide 170. It can be seen, in the embodiment, that the third locking portion 186 of the slide 170 forms a receptacle in which the projections of the first locking portion 182 and of the second locking portion 184 are received, in the locking position of the slide 170, while the projections are retracted out of the receptacle 186 of the slide 170 in the unlocking position.

A front edge 169 of the slide 170 in the x-direction forms a boot contact portion and is positioned, in the locking position, such that it strikes a rear face of a touring ski boot which is retained at the coupling means 118, in the downhill position. Furthermore, the slide 170 is designed such that the unlocking position thereof is in front of the locking position in the x-direction (direction of travel). As a result, in the downhill position the touring ski boot prevents unintentional movement of the slide 170 into the unlocking position.

It is furthermore apparent, from comparing FIGS. 10*b* and 11*b*, that the parallel offset of the axes of rotation V and A makes it possible for eccentric mounting of the second binding member 144 relative to a housing of the second binding member 144 to be achieved, as a result of which, in the downhill position shown in FIG. 10*b*, the coupling means 118 and the housing of the second binding member 144 are arranged relatively far towards the front in the direction of travel (x-direction) and thus can come into good engaging contact with the touring ski boot, while the housing of the second binding member 144 is arranged, in the walking position shown in FIG. 11*b*, relatively far towards the rear, and thus at a sufficiently large spacing from the touring ski boot, in the x-direction, in order to reliably prevent a collision between the second binding member 144 and the touring ski boot.

A third embodiment of the present invention will be described in greater detail in the following, with reference to FIGS. 13*a* to 13*e*. In the description of the third embodiment, too, only the differences with respect to the first embodiment will be discussed in greater detail, while with respect to all the remaining features reference is made to the description of the first embodiment. Features and functions which are not described again in the third embodiment, can be transferred, in the same or in a corresponding manner from the first embodiment to the third embodiment.

A heel unit 210 of the third embodiment comprises a first binding member 232 that is rotatably mounted on a base 212, a second binding member 244 that is retained in a rotatable manner with respect to the first binding member 232, and coupling means 218 which are retained at the second binding member 244. In the third embodiment, the second binding member 244 is mounted on the base 212 so as to be rotatable about the adjustment axis of rotation V that extends in the z-direction. For this purpose, in particular a first annular projection 223 of the base 212 can be engaged in a second annular projection 245 of the second binding member 244, such that the base 212 and second binding member 244 are rotatable with respect to one another, but axially fixed, with respect to the adjustment axis of rotation V.

The first binding member 232 is also rotatably mounted on the base 212, preferably so as to be rotatable about a release axis of rotation A extending coaxially with the adjustment axis of rotation V. For this purpose for example a radially outer first counter bearing portion 230 of the first binding member 232 is guided on a radially inner first bearing portion 228 of the base 212.

A release spring 240, in the embodiment in particular two release springs 240 extending so as to be mutually parallel, can be received in a spring receptacle 238 of the first binding member 232, which release spring is supported at one side on a spring stop 242 retained on the first binding member 232, and at the other side on a latching member 234 that is displaceably held on the first binding member 232. The latching member 234 preferably comprises a latching projection 235 which is designed for engaging in a matching latching depression 229 on the base 212, in particular on the first bearing portion 228. In the case of a rotation of the first binding member 232 about the release axis A, the latching member 234 is pushed out of the latching depression 229, counter to the force of the release spring 240, such that the rotation of the binding member 232 out of the central downhill position is opposed by a release force. The position of the spring stop 242, with respect to the first binding member 232, can be set by means of an adjustment screw 243, in order to change the preload of the release spring 240, and thus the release force.

The second binding member 244 and the first binding member 232 can be coupled together for conjoint rotation (locking position) or decoupled from one another (unlocking position) by operating the actuation portion 280. In the unlocking position, the second binding member 244 can twist independently of the first binding member 232, only possible frictional forces in the region of the bearing with the base portion 212 (e.g. between the annular projections 223 and 245) are to be overcome, such that the force required for adjusting the binding member, and thus the coupling means 218, between the downhill position and walking position, is zero or substantially zero, but in any case less than the release force required for rotating the first binding member 232 relative to the base 212.

The actuation assembly preferably comprises a first latching contour 266 arranged on the first binding member 232, and a second latching contour 268 retained on the second b 244, which latching contours can be adjusted relative to one another, by means of actuation of the actuation portion 280 by a user, such that they can be brought into latching engagement with one another, in order to block a rotation between the binding members 232, 244, or can be released from the latching engagement, in order to release the relative movement between the binding members 232, 244. The first latching contour 266 can be provided as a recess in the first binding member 232, while the second latching contour 268 can be designed as a matching projection. The second latching contour 268 can in particular be arranged on a lever 283 that is mounted on the second binding member 244 so as to be pivotable about a swivel pin 281, which lever also comprises the actuation portion 280. Actuation of the actuation portion 280, and the associated pivot movement of the lever 283, then makes it possible for the second latching contour 268 to optionally be brought into engagement with the first latching contour 266 or to be released from the engagement therewith. In this way, it is possible for the heel unit 210 to be adjusted between the locking position and the unlocking position.

The actuation portion 280 can be positioned such that it forms a boot contact portion 269 and is pushed into the locking position or held in the locking position by means of a heel portion of the touring ski boot that is held at the coupling means, in the downhill position, such that unintentional adjustment of the actuation assembly into the unlocking position can be prevented.

In the third embodiment, too, the base 212 can be formed in two parts if desired, comprising a first base portion 220 which is to be fastened to a sliding board by means of a suitable fastening assembly, in particular fastening screws, and a second base portion 222 which is displaceably guided on rails, extending in the x-direction, with respect to the first base portion 220, in order to provide setting of the binding and/or a resilient contact pressure on the touring ski boot in the downhill position.

The invention claimed is:

1. A heel unit for a touring binding, comprising:

a base for mounting on a sliding board;

coupling means to engage with a heel portion of a sliding board boot in a downhill position of the touring binding to retain the sliding board boot on the touring binding, a release mechanism to hold the coupling means so that the coupling means is rotatable relative to the base such that the coupling means can be released from the engagement with the sliding board boot in the downhill position of the touring binding in an event of action of a force that exceeds a predetermined release force, wherein the release mechanism comprises a spring means that determines the predetermined release force; and an adjustment mechanism to rotatably adjust the touring binding between the downhill position and a walking position, wherein the coupling means are arranged in the adjustment mechanism in a position remote from the sliding board boot such that the coupling means do not come into engagement with the sliding board boot, wherein the adjustment mechanism comprises an actuation assembly that is manually actuatable between a locking position in which the adjustment mechanism is locked in the downhill position or in the walking position, and an unlocking position in which the adjustment mechanism is unlocked and is rotatable from the downhill position into the walking position or from the walking position into the downhill position substantially without an actuation force or with an actuation force that is less than the predetermined release force.

2. The heel unit according to claim 1, wherein the release mechanism holds the coupling means relative to the base in a rotatable manner about a release axis of rotation extending orthogonally to a sliding board plane.

3. The heel unit according to claim 1, wherein the adjustment mechanism holds the coupling means relative to the base in a manner rotatable between the downhill position and the walking position about an adjustment axis of rotation extending orthogonally to a sliding board plane.

4. The heel unit according to claim 2, wherein the release axis of rotation extends, at a spacing, in parallel with an adjustment axis of rotation or coaxially to the adjustment axis of rotation.

5. The heel unit according to claim 1, further comprising:

a first binding member that is movable relative to the base, by means of a release mechanism for a release movement, such that the first binding member moves relative to the base, in the downhill position of the touring binding, upon action of a force that exceeds the release force, and is retained on the base, with respect to the release movement, upon action of a force that does not exceed the release force; and a second binding member that carries the coupling means and is movable relative to the first binding member, by means of the adjustment mechanism.

6. The heel unit of claim 5, wherein the first binding member is movably mounted on the base.

7. The heel unit of claim 5, wherein the first binding member is movably mounted on the base on a first bearing, and wherein the second binding member is movably mounted on the base on a second bearing, wherein the second bearing is separate from the first bearing.

8. The heel unit according to claim 5, wherein, in the locking position of the actuation assembly, a relative movement between the first binding member and the second binding member is blocked, and wherein, in the unlocking position of the actuation assembly, a relative movement between the first binding member and the second binding member is made possible substantially without an actuation force or with an actuation force that is smaller than the predetermined release force.

9. The heel unit of claim 5, wherein the actuation assembly allows a displacement between the first binding member and the second binding member, in the unlocking position.

10. The heel unit of claim 9, wherein the actuation assembly is pivotably attached to the heel unit, and further comprising a hinge mechanism to convert a pivot movement of the actuation assembly into a translational movement between the first binding member and the second binding member.

11. The heel unit of claim 1, wherein the actuation assembly is pivotably attached to the heel unit by means of a dead-center mechanism, such that the actuation assembly is preloaded towards the locking position, in the locking position, and such that the actuation assembly passes through a dead center, in a case of a movement towards the unlocking position, to reverse the direction of the preload.

12. The heel unit of claim 1, wherein the actuation assembly is held on the heel unit and is displaceable between the locking position and the unlocking position.

13. The heel unit of claim 1, wherein the actuation assembly is held on the heel unit and is pivotable between the locking position and the unlocking position.

14. The heel unit of claim 5, wherein the actuation assembly blocks a relative movement between the first binding member and the second binding member, in the locking position.

15. The heel unit of claim 1, wherein the actuation assembly comprises a boot contact portion which, in a downhill position of the heel unit, comes into resting contact with a heel portion of the sliding board boot held at the coupling means, wherein one or more of the actuation assembly or the adjustment mechanism is pushed or held into the locking position responsive to a force acting on the boot contact portion in a direction directed away from the sliding board boot.

16. The heel unit of claim 5, wherein the second binding member is movably mounted on the first binding member.

17. The heel unit of claim 9, wherein the actuation assembly allows the displacement between the first binding member and the second binding member, in the unlocking position, to allow a displacement in a direction extending orthogonally to one or more of a release axis of rotation or an adjustment axis of rotation, and to block the displacement in the locking position.

18. The heel unit of claim 12, wherein the actuation assembly is held so as to be displaceable in a direction in parallel with a sliding board longitudinal axis.

19. The heel unit of claim 13, wherein the actuation assembly is held so as to be pivotable about a pivot axis extending in parallel with a sliding board plane and orthogonally to a sliding board longitudinal axis.

20. The heel unit of claim 14, wherein the actuation assembly blocks the relative movement between the first binding member and the second binding member in a form-fitting manner.

* * * * *